US009429083B2

(12) United States Patent
Gumaer

(10) Patent No.: US 9,429,083 B2
(45) Date of Patent: Aug. 30, 2016

(54) SYSTEM AND METHOD FOR INTEGRALLY CONTROLLING A TRANSMITTER VIA A VEHICULAR OPERATION

(71) Applicant: Lennard A. Gumaer, Bloomfield Hills, MI (US)

(72) Inventor: Lennard A. Gumaer, Bloomfield Hills, MI (US)

( * ) Notice: Subject to any disclaimer, the term of this patent is extended or adjusted under 35 U.S.C. 154(b) by 366 days.

(21) Appl. No.: 14/257,471

(22) Filed: Apr. 21, 2014

(65) Prior Publication Data

US 2014/0316674 A1 Oct. 23, 2014

Related U.S. Application Data

(60) Provisional application No. 61/813,907, filed on Apr. 19, 2013.

(51) Int. Cl.

| | |
|---|---|
| ***F24F 11/00*** | (2006.01) |
| ***F02D 29/02*** | (2006.01) |
| ***F24F 7/007*** | (2006.01) |
| *F02N 19/02* | (2010.01) |

(52) U.S. Cl.

CPC ..... *F02D 29/02* (2013.01); *F24F 7/007* (2013.01); *F02N 19/02* (2013.01); *F24F 11/0001* (2013.01)

(58) Field of Classification Search

CPC ..... F24F 11/00; F24F 11/001; F24F 7/007

USPC ..... 60/315; 701/102; 454/49

See application file for complete search history.

(56) References Cited

U.S. PATENT DOCUMENTS

| | | | | |
|---|---|---|---|---|
| 4,216,710 | A * | 8/1980 | Asmus | B08B 15/002 104/52 |
| 5,092,228 | A * | 3/1992 | Pfeiffer, Jr. | B08B 15/00 104/52 |
| 5,362,273 | A * | 11/1994 | Pfeiffer, Jr. | B08B 15/002 454/63 |
| 5,542,250 | A * | 8/1996 | Ball | F24F 7/06 454/63 |
| 5,630,751 | A * | 5/1997 | Hansen | F23J 11/02 454/64 |
| 5,679,072 | A * | 10/1997 | Brodin | B08B 15/002 285/62 |
| 5,947,814 | A * | 9/1999 | Czeck | F24F 11/0001 454/195 |
| 6,139,422 | A * | 10/2000 | Blaschke | B08B 15/002 454/166 |
| 6,306,031 | B1 * | 10/2001 | Hansen | B08B 15/002 454/63 |
| 2005/0022521 | A1 * | 2/2005 | Patry | B08B 15/002 60/298 |
| 2010/0066082 | A1 * | 3/2010 | Aubert | B08B 15/002 285/408 |
| 2015/0219350 | A1 * | 8/2015 | Gumaer | F24F 11/0001 454/343 |

* cited by examiner

*Primary Examiner* — Erick Solis

(74) *Attorney, Agent, or Firm* — Dickinson Wright PLLC

(57) ABSTRACT

A vehicle device and method for controlling facility exhaust ventilation systems in facilities related to first responder and other commercial vehicles, wherein the device and method automatically reengages operation of the facility exhaust ventilation system, based on vehicle status inputs.

23 Claims, 6 Drawing Sheets

SYSTEM AND METHOD FOR INTEGRALLY CONTROLLING A TRANSMITTER VIA A VEHICULAR OPERATION

CROSS-REFERENCE TO RELATED APPLICATION

This U.S. Utility patent application claims the benefit of U.S. Provisional Patent Application Ser. No. 61/813,907 filed on Apr. 19, 2013 entitled "System And Method For Integrally Controlling A Transmitter Via A Vehicular Operation," the entire disclosure of the application being considered part of the disclosure of this application, and hereby incorporated by reference.

BACKGROUND

First responders, the military and other commercial operations often store and use vehicles inside a static or fixed location or facility. For example, fire stations typically store vehicles in a garage or apparatus room of a fire station, and many times those vehicles are running on some occasions while inside the facility. Other examples of where vehicles are stored or operated inside a fixed location or facility include maintenance garages, airport hangers, police stations, loading facilities, shipping facilities, military facilities or any other setting where it is desirable at times to have a vehicle powered by an internal combustion engine or the like running even for short time periods in an enclosed area. The fixed location where the vehicles are stored may be augmented with various systems and devices ensuring optimal, efficient, and safe-handling, storage and maintenance of the vehicles in such an enclosed area.

Operation of vehicles generally results in the generation of exhaust gases and particulate matter such as soot, much of which may not be visible directly to the human eye. The majority of first responder and commercial vehicles in these facilities are diesel vehicles, which are known to produce particulate matter harmful to humans when reaching an excess of certain specified levels. If these vehicles are operated inside an enclosed facility, the exhaust gases and particulates in the air may quickly increase. Exhaust gases from many internal combustion engines may also contain carbon monoxide and hydrogen sulfide, which are gases harmful to humans even in low concentrations, as well as carbon dioxide in large quantities, which may displace the available oxygen in an enclosed area, reducing available oxygen for breathing which may lead to asphyxiation or death.

To reduce potential health and safety issues of operating vehicles in enclosed spaces for even short time periods, many fixed locations may be equipped with an exhaust ventilation system for removing exhaust fumes from running vehicles. Exhaust ventilation systems are configured to capture the exhaust gases from the vehicles and transport the gases and particulate matter outside the building, sometimes filtering the air to remove particulate matter before exhausting the captured gases outside the facility. The exhaust ventilation system may have a variety of configurations but almost all systems include an exhaust fan at the facility operationally coupled to a vehicle's exhaust system through various ducts and hoses. More specifically, various ventilation system manufacturers offer competitive solutions for implementing such exhaust ventilation systems which typically include at least one flexible exhaust capture hose, which attaches to or is positioned proximate to a vehicle's exhaust system and is coupled to a blower; a network of rigid or flexible ductwork extending between the at least one flexible exhaust capture hose and the blower; a control system which activates the blower and also typically provides overcurrent protection to the motor of the blower; and a remote control system that uses a vehicle-initiated signal to activate the system based on simple physical proximity of the vehicle to the building. In operation, the hoses attach or are coupled to the vehicle exhaust system to evacuate exhaust fumes and soot before they can enter the air of the facility to prevent toxic fumes, gas, or particulate matter buildup in the air. The vehicle's combustion gases and particulate matter are then pulled through the network of rigid or flexible ductwork by the blower and vented outside of the facility. Therefore, the exhaust ventilation system reduces occupational exposure to exhaust fumes for first responders and other workers in such facilities, particularly where long exposures may occur, such as the first responders living at the facility or workers or employees that are continually exposed to vehicle exhaust fumes in enclosed spaces. Toxic fumes, gases and airborne particulate matter have been implicated as occupational health risks. Many first responder, airport, military, and commercial vehicles are situated in a fixed location which is enclosed and the vehicles may be kept running for extended periods of time or before responding to a call or task due to various operational conditions. While these vehicles are running, the facility's exhaust ventilation systems allow humans to avoid exposure to vehicle exhaust particulates and gases which have known health risks.

These exhaust ventilation systems are typically configured to be operational in response to a stationary vehicle being situated within and running in the fixed location. Once the vehicle leaves the fixed location, the exhaust ventilation system ideally turns off automatically. In this way, the energy use of the exhaust ventilation system is minimized. In addition, many first responder garages, facilities, and enclosed spaces are climate controlled and leaving the exhaust ventilation system on for extended time periods, while not coupled to a vehicle, quickly removes the conditioned air in the facility, increasing operational costs of the facility.

One technique for ensuring that the exhaust ventilation systems are turned off when no longer necessary is the installation of a proximity transmitter device in each vehicle. The vehicle proximity transmitter device communicates wirelessly with a reception unit or receiver situated in the fixed facility and attached to a controller associated with the facility exhaust ventilation system. In response to the vehicle or set of vehicles being outside a predetermined range (or a range based on the capabilities of the wireless transmission), the controller may issue a command to shut down operation of the exhaust ventilation system. For example, in response to the vehicle being situated at a specific distance away from the fixed location that includes the exhaust ventilation system, the evacuation functionality may be disabled. In order to accomplish this, a communication unit (or receiver unit) associated with the exhaust ventilation system may be equipped with a polling function that listens to the first responder vehicle transmitters and based on a non-response, a signal may be generated to instigate a disabling of the evacuation function. The transmitter in the vehicle may also communicate, such as through lack of signal that the vehicle has been shut down and there is no longer any need for the exhaust ventilation system to be operational. One problem with this automatic control is if the human operators shut off the vehicle proximity transmitter, it could cause the system to not function when the vehicle enters the enclosed space.

Often times, a vehicle may still be within the wireless range of the exhaust ventilation system's communication unit, but not physically be within the confines of the fixed location. For example, many fire departments conduct training in the parking lot of the facility that stores the vehicles, well within proximity range of the communicator or receiver in the facility, but outside the facility. While some vendors recommend manually disconnecting the power leads to the proximity transmitter in the vehicle to prevent nuisance activation, that procedure may void the warranty of the exhaust ventilation system. Problems occur when a vehicle is hooked up or operationally coupled to the facility exhaust system and the vehicle is running but the evacuation function of the exhaust ventilation system is not active due to the proximity transmitter in the vehicle not being active. For example, not only may the hoses that attach the exhaust ventilation system to the tailpipe of the vehicle be damaged by the heat of the vehicle exhaust; carbon monoxide, toxic fumes and particulate matter may accumulate unnoticed to any incidental humans in the facility. Any vehicle running in an enclosed facility and not connected to an operating exhaust ventilation system creates a dangerous situation, particularly if the incidental humans in the facility believe the system is active. Therefore, prevailing wisdom in the industry is that the vehicle proximity transmitters in the vehicles should never be disabled, without a reliable mechanism to automatically re-enable the transmitter. Thus, the exhaust ventilation system in the facility commonly will still perform an evacuation function while the vehicle is outside the facility, within a set proximity and is running. In these situations, the exhaust ventilation system will not be disabled, and will continue operation even though it is not needed, thus, wasting energy associated with the operation of the exhaust ventilation system and adding unnecessary use of the exhaust ventilation system, when such system is not needed. In addition, when a vehicle equipped with a transmitter drives past a fixed location, it may cause the exhaust ventilation system or similar device to turn on in the facility, even though the vehicle has no desire to enter the fixed location or facility, and may not even be based at that location. Most current exhaust ventilation systems that have the ability to automatically turn off and on typically use a simple RF transmitter mounted in the vehicle communicating with a stationary receiver mounted in the building as the means of signaling the control panel to activate the exhaust system blower motor, and some systems use a coded transmitter to reduce false starts or nuisance activations. More specifically, while relatively low-cost and simple, the RF transmitters and receivers have a large and variable activation range, and can activate due to vehicles tens to hundreds of feet from the building, resulting in nuisance activations of the exhaust system. To reduce the nuisance activations, a transmitter encoding scheme is used to associate specific transmitters with specific receivers. For example, a fire department with two fire station buildings, each with an exhaust ventilation system, might elect to program the vehicle transmitters for each building with different codes. Thus, a vehicle normally used in a first station traveling past a second station within range of the RF receiver would not activate the exhaust system of the second station. Unfortunately, this creates a new and more problematic nuisance if a vehicle normally used in a first facility is temporarily relocated to a second facility. If the change is permanent, the transmitter modules could be manually swapped between vehicles or the systems could be reprogrammed to recognize different codes. However, for companies or environments with large numbers of buildings and vehicles, such manual swapping or reprogramming would be unacceptably tedious, time-consuming, and still could cause serious issues if the operators of the vehicle expect the system to automatically function and it does not operate. As such, one primary weakness of the present RF transmitter/receiver solution for automating the off and on cycling of exhaust ventilation systems is that the transmitters typically have a coverage range of thousands of square feet, making it not uncommon for a vehicle containing a transmitter to activate a building exhaust system receiver from over 500 feet away. This 500 foot radius is well within many areas where a vehicle will be operational, but not inside the facility, such as where outdoor training occurs for first responder vehicles.

SUMMARY OF THE INVENTION

The present invention is generally directed to a vehicle device and method for controlling facility exhaust ventilation systems in facilities related to first responder and other commercial vehicles, wherein the device and method automatically re-engages operation of the facility exhaust ventilation system, based on vehicle status inputs.

The present invention is further directed to a vehicle device for controlling exhaust ventilation systems in facilities. The vehicle device includes a transmitter; a controller in communication with the transmitter; an input unit and a brake input unit. The input unit is in communication with the controller and capable of receiving an operator input from an operator of a vehicle. The operator input may include an activation input and a deactivation input. Upon receiving the deactivation input, the controller sends a deactivation signal to the transmitter, placing the transmitter into a deactivated state. The deactivation signal may be as simple as cutting power to the transmitter or antenna or intercepting any signals from being wirelessly sent by the transmitter. Upon receiving an activation input, the controller sends an activation signal to the transmitter, placing the transmitter into an active state, which may be as simple as restoring power to the antenna or transmitter.

The brake input unit is capable of receiving a brake input from the brake system on the vehicle. The brake input may include a brake active signal and a brake inactive signal and wherein the controller upon receiving a brake active signal from the brake unit, sends an activation signal to the transmitter placing the transmitter into the active state.

The vehicle device may be configured to send a deactivation signal to the transmitter upon receiving a brake active signal, while receiving a deactivation input from the input unit.

The vehicle device may further include an indicating unit configured to indicate whether the transmitter is in an active state or a deactivated state. The indicating unit may be further provided to indicate what facility, and what facility exhaust system the vehicle is in communication with. The indicator unit may provide any desired status output to the operator. The vehicle device may further include a unique ID that is transmitted by the vehicle to the facility. The unique ID allows the vehicle to be associated with a particular facility and wherein a unique ID not associated with a facility will not activate a vehicle facility exhaust system facility not associated with the unique ID. A thumbwheel or other mechanism, such as a rotary switch, for selecting which facility the vehicle is associated with may also be included.

The vehicle device may further include a proving circuit or controller configured to determine the state of the transmitter. A simple proving circuit may be provided, however the function of the proving circuit may be encompassed by a controller with more functionality.

The present invention is also directed to a method of controlling a vehicle exhaust system in a building with a vehicle device on a vehicle, the vehicle facility exhaust system including a receiver and the vehicle device including a controller, a transmitter, an input unit, and the vehicle having a power supply and a brake system. The method generally includes the steps of: determining that the transmitter is providing an activation signal; monitoring for a deactivation signal from the input unit; receiving a deactivation signal from the input unit; outputting a deactivation signal to the transmitter; monitoring for a vehicle input signal related to initiating movement of the vehicle; receiving the vehicle input signal; outputting an activation signal to the transmitter upon receiving the vehicle input signal; and communicating an activation signal to the receiver with the transmitter.

The step of receiving a vehicle input signal may include at least one of (1) receiving the brake active signal from the brake system and (2) a change in gear status.

The step of receiving a vehicle input signal may include the steps of monitoring for a brake active signal from the brake system; and receiving a brake active signal from the brake system.

The step of receiving a brake active signal from the vehicle brake system may include at least one of (1) receiving a voltage signal or a change in voltage when the brake lights are illuminated, (2) receiving input activated by movement of the brake pedal, (3) receiving input related to a change in braking system pressure, (4) receiving an input from the a Controller Area Network (CAN) of the vehicle related to the status of the brake system, and (5) releasing of the parking brakes.

The step of outputting a deactivation signal to the transmitter may be configured to deactivate power supplied to the transmitter.

The method may further include one or more of the steps of providing an output status, leaving the facility with the vehicle and wherein the transmitter is active upon leaving the facility; parking the vehicle within range of the receiver; and creating a deactivation signal with the input unit.

The step of receiving the input signal may include the step of moving the brake pedal. Likewise, the step of outputting an activation signal to the transmitter upon receiving the vehicle input signal automatically occurs. The step of outputting an activation signal to the transmitter upon receiving the vehicle input signal may further include the step of ignoring any deactivation signal being provided from the input unit upon receiving the vehicle input signal.

The method may further including the steps of moving the vehicle with the transmitter providing an activation signal; and ignoring any deactivation signal received from the input unit from the input unit until a vehicle stop condition is determined.

The vehicle stop condition may be at least one of (1) placing the transmission in park, (2) activating the parking brake, and (3) sustained speed of zero.

In addition, the present invention is directed to a method of controlling a vehicle exhaust system in a building with a vehicle device on a vehicle, the facility exhaust system including a receiver and the vehicle device including a controller, a transmitter, an input unit, and the vehicle having a power supply and a brake system, the method comprising the steps of: determining that the transmitter is providing an activation signal; monitoring for a deactivation signal from the input unit; receiving a deactivation signal from the input unit; determining a desired vehicle status exists, wherein the desired vehicle status includes at least one of: (1) engine speed, (2) brake status, (3) transmission status, (4) change in transmission status, (5) parking brake status, (6) proximity to facility exhaust system, and (7) speed of the vehicle. The method further includes the steps of outputting a deactivation signal to the transmitter after the step of determining a vehicle status; monitoring for a vehicle input signal related to initiating movement of the vehicle; receiving the vehicle input signal of at least one of (1) receiving the brake active signal from the brake system and (2) a change in gear status; automatically outputting an activation signal to the transmitter upon receiving the vehicle input signal; communicating an activation signal to the receiver with the transmitter; and providing an output status. Regardless of the status of the device, it can always be reset to a known condition by a power cycle. As such, upon power up the device always initiates to a failsafe status.

The step of outputting an activation signal to the transmitter upon receiving the vehicle input signal further includes the step of ignoring any deactivation signal being provided from the input unit upon receiving the vehicle input signal.

The method may further include the steps of moving the vehicle with the transmitter providing an activation signal; and ignoring any deactivation signal received from the input unit from the input unit until a vehicle stop condition is determined.

The vehicle stop condition may be at least one of (1) placing the transmission in park, (2) activating the parking brake, and (3) sustained speed of zero.

DESCRIPTION OF THE DRAWINGS

The detailed description refers to the following drawings, in which like numerals refer to like items, and in which.

DETAILED DESCRIPTION

Disclosed herein are systems and methods to integrally control a transmitter-based function associated with a fixed location with a vehicular operation. By integrating the control of the transmitter with the operation of the vehicle, the enabling and disabling of a transmitter becomes seamless, and prevents dangerous situations. In addition, the system and method of operating exhaust ventilation systems in a facility is also disclosed and discussed.

Figure 4:
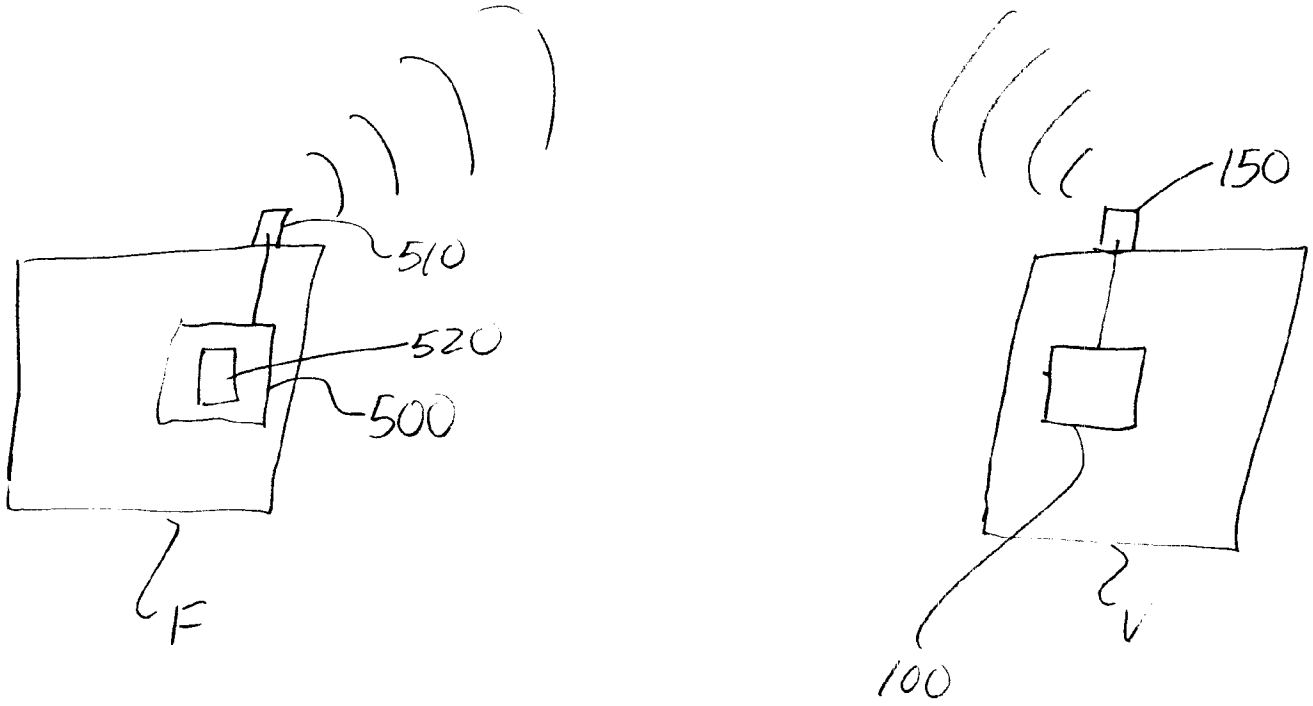
FIG. 4 is a block diagram of the facility including the facility exhaust system and the vehicle, including the vehicle device. illustrates an exemplary transmitter and control system.
Figure 5:
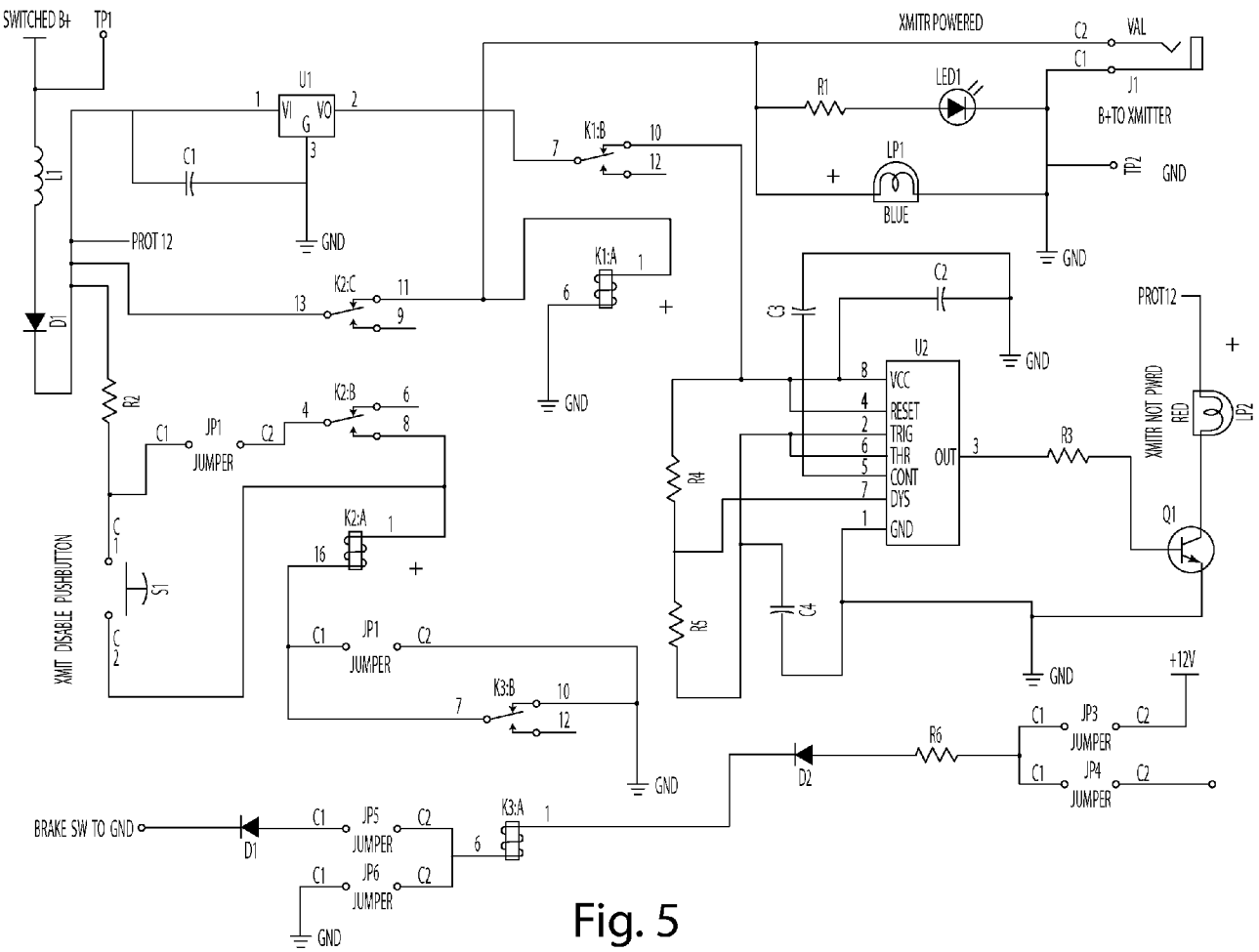
FIG. 5 is an exemplary schematic view of the transmitter and control system.

As illustrated in FIG. 4, the facility F may include a facility vehicle exhaust system 500, which includes a controller having a receiver 520 and an antenna or transmitter 510 in communication with a vehicle V, having the vehicle device 100 including a transmitter 150. The vehicle may be formed without a receiver and only transmit, however, certain advantages may occur if the vehicle is able to receive transmissions from the facility exhaust system 500.

In response to a vehicle being within wireless range of a communication unit associated with a fixed location, while not being in the fixed location, a human operator of the vehicle may manually disable a transmitter associated with the vehicle. However, because the process to disable the transmitter is manual, and often times not intuitive, it may create a dangerous situation if the operator does not reactivate the transmitter before returning the vehicle to the fixed location. More specifically, because the transmitter is manually disabled, various services, such as the exhaust ventilation system for evacuating exhaust fumes and particulate matter may not be engaged if the vehicle is left running in an enclosed fixed location.

Disclosed herein are the methods and systems to integrally control a transmitter-based function associated with a fixed location via vehicle inputs related to an operation associated with a vehicle. Because the vehicle inputs related to operation of the vehicle are integrated with a commonplace vehicular operation, the disabling and enabling of a function, particularly re-enabling is seamlessly performed when the proximate first responder vehicle is returned to an enclosed fixed location.

In this way, if the function being performed is the removal of exhaust fumes and particulate matter from a fixed location, a safe and healthy environment may be promoted. Further, wear to various components and unnecessary energy consumption may be avoided.

Figure 1:
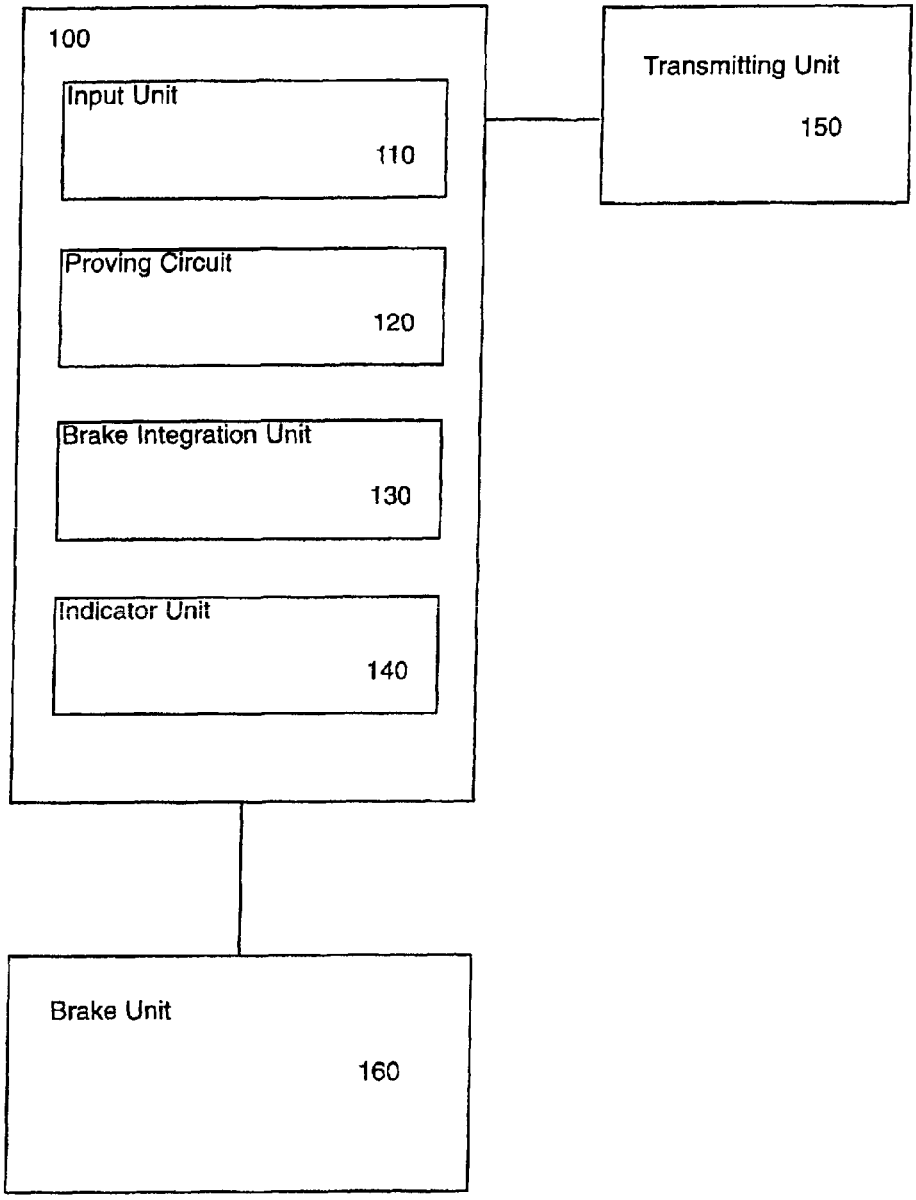
FIG. 1 is a block diagram illustrating an example system for integrally controlling a transmitter via a vehicular operation.

FIG. 1 is a block diagram illustrating an example system 100 for integrally controlling a transmitter via a vehicular operation. The system 100 may be employed on an electronic device as described herein. The system 100 includes an input unit 110, a proving circuit 120, a brake integration unit 130, and an indicating unit 140, such as a light-emitting diode (LED) unit or annunciator. A processor (not shown), may be included with system 100 to aid and augment the implementation of the various elements associated with the system 100.

The system 100 connects to a transmitting unit 150, and to a brake unit 160. The transmitting unit 150 and the brake unit 160 may be situated in the vehicle (not shown). The brake unit 160 may provide the vehicle inputs used by the system 100.

The input unit 110 receives an input from a human operator of the system 100. The input unit 110 may be implemented with a rocker switch, or the like. Thus, the input unit 110 receives an input by a human operator to indicate that the system 100 may instigate a signal to disable the transmitting unit 150.

The proving circuit 120 indicates that power is active, such as a DC voltage is applied to the transmitting unit 150. By indicating that power is applied to the transmitting unit 150, an operator of the first responder vehicle may be cognizant of the transmitting unit 150 being operational.

Further, the proving circuit 120 may be implemented as a separate circuit from the other elements of system 100. By doing so, this ensures that the indication of the power applied state of the transmitting unit 150 is independent and not contingent or falsely reported based on an error associated with the other elements.

To reactivate the transmitter, the brake integration unit 130 receives an indication that the brakes from a vehicle have been activated from the brake unit 160. Thus, in response to a human operator of the vehicle asserting a braking action, a signal is transmitted to the brake integration unit 130. The brake unit 160 may be hardwired from the brake system of the vehicle, such as receiving a voltage signal when the brake lights are illuminated, or input from a separate switch that is activated by movement of the brake pedal, or by a change in braking system pressure. Alternatively, the brake unit 160 may be connected to a Controller Area Network (CAN) through which the vehicle brake system electrically communicates. In either case, the vehicle is capable of communicating to the system 100, via the brake unit 160, that a braking action has occurred, initiated by a human operator.

The processor determines whether an indication is made and provides an output to the indicating unit 140, of course the indicating unit 140 may include its own processor. As stated above, the indicating unit 140 may be an LED associated with the system 100 such as the color of the signal or LED to be displayed. In an example operation, a red LED is indicated if the brake integration unit 130 is detected. A rationale for selecting the red LED is that in first responder vehicle human/computer interactions, red is often used for important and critical functions. Additionally, blue may be employed to indicate that power is applied to the transmitting unit 150. Of course, other recognizable notification or indications may be used.

The operation of system 100, in performing the integral controlling of a transmitter via a vehicular operation is described in greater detail below with regards to FIGS. 2A and 2B.

Figure 2A:
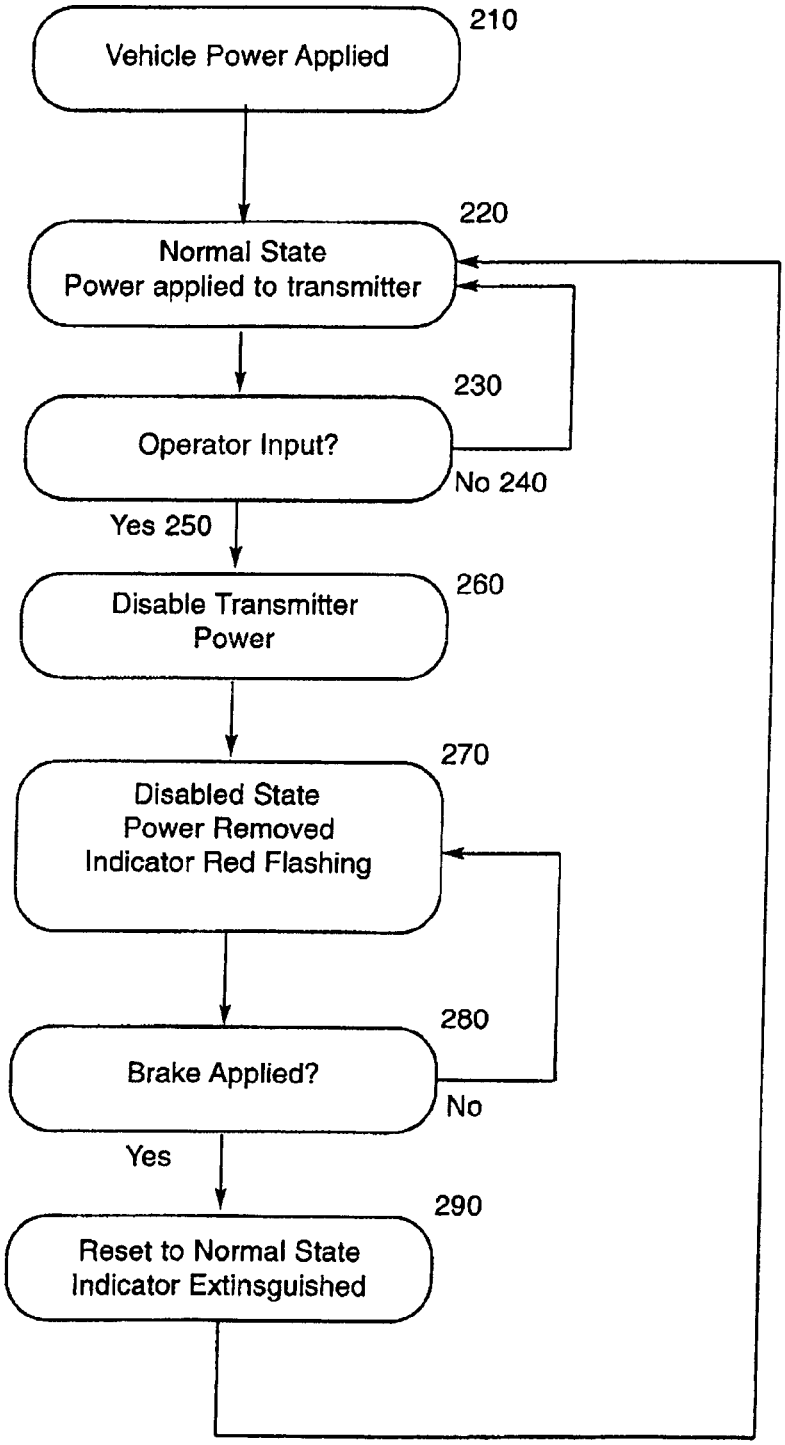
FIG. 2*a* is a state diagram illustrating an example method for integrally controlling a transmitter via a vehicular operation.
Figure 2B:
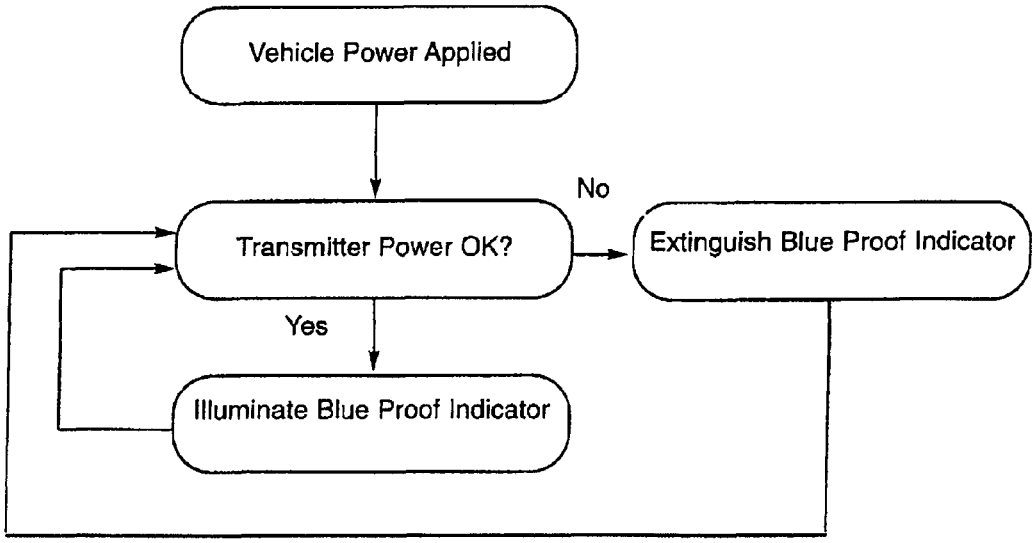
FIG. 2*b* is a state diagram of the proving circuit.

FIGS. 2A and 2B illustrates an example method and state machine 200 for integrally controlling a transmitter via a vehicular operation. The method 200 may be implemented on the system 100 described above.

If a vehicle is moved to a location outside of the facility, the operation of the system 100 will be as described below. Upon starting the vehicle, vehicle power is applied 210 to the system. The system 100 in the vehicle will be active and communicating with the exhaust ventilation system. As the vehicle exits the facility, the system 100 will be its normal state 220, and the exhaust ventilation system will be active so long as the transmitter is within range of a receiver in the facility.

If the operator of the vehicle desires to deactivate the exhaust ventilation system while the vehicle is running within transmitter proximity range of the facility, the vehicle is first parked in a desired location. Once the vehicle is properly parked, such as with the parking brake set or any other safety any other safety measures applied outside of the facility, that vehicle's transmitter in communication with the exhaust ventilation system may be deactivated. As such, the exhaust ventilation system will not be active while such vehicle is operational outside of the facility.

The system 100 awaits an input for deactivation. The system 100 is in a waiting state 230 for an input. If the vehicle drives away from the facility, no input is provided 240 and it remains in its normal state 220.

In operation 210 a deactivation input 250 is provided by the human operator to the system 100 or detected by the system, the system will take steps to deactivate the transmitter. More specifically, in operation 220, if a human operator deactivates the transmitter 250, the indicator unit 140 may flash a red LED on system 100 alerting a human operator to such deactivation and by acknowledging the input 250 and deactivates 260 the transmitter to enter a disabled state 270. The system 100 upon deactivating the transmitter reports the changed state 270 of the transmitter with the indicator unit 140, such as the mentioned flashing LED or some other method of notification. With the exhaust ventilation system properly disabled, any activities, such as training may occur. After the training is complete, the operator may desire to return the first responder vehicle to the facility.

Upon receiving a vehicle status change input, such as a brake status input 280, the system 100 may be reset 290 and enter the normal state 220. Of course the system 100 may repeat the process. More specifically, in operation an operator provides a vehicle status signal change, such as providing a braking system input through activation of the vehicle brakes, release of the vehicle parking brakes and the like. The brake integration unit 130 may receive a signal from the brake unit 160 that the operator has applied the brakes, even temporarily, of the vehicle.

In the disabled state 260, the power is typically cut to any connected transmitter. Upon resetting 290 a determination is made as to whether an input is asserted. If the input unit 110 detects that an input is asserted, the method 200 proceeds to see that power is supplied to a transmitting unit 150. In this case with power supplied, the transmitting unit 150 initiates or maintains wireless communication with a receiver at the fixed location, thereby maintaining the operation of the exhaust ventilation system controlled by the receiver.

As stated above, the proving circuit 120 provides a detection of whether the transmitting unit 150 is connected to a power supply. As explained above, because the proving circuit 120 is not associated with the circuitry used to implement an input unit 110 and the other elements of system 100, the integrity of the data being displayed is enhanced. Operation of the proving circuit is illustrated in FIG. 2*b*.

In operation power to the transmitter is automatically applied after a detection of activation of the brakes. Thus, a resuming of the operation of a device associated with a receiver in a fixed location occurs without any sort of manual human interaction (other than the normal operation of the first responder vehicle).

Figure 3:
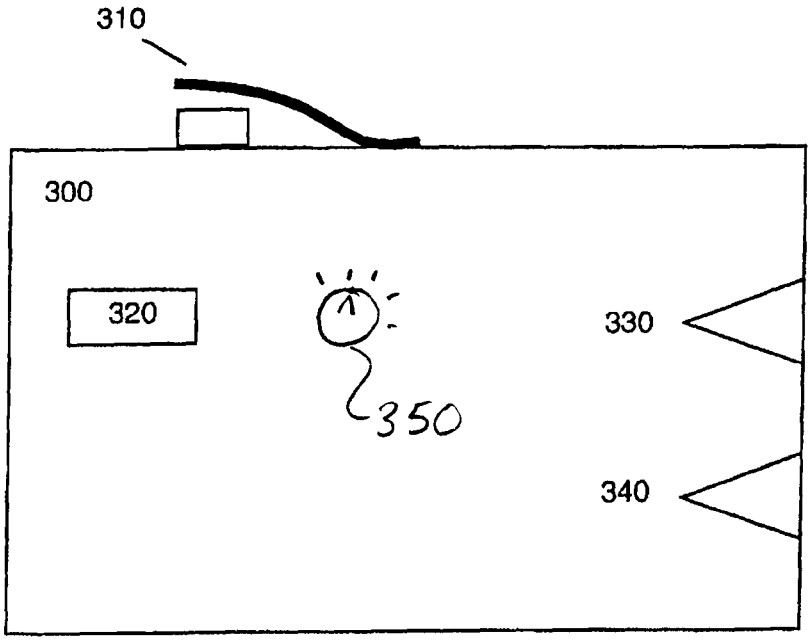
FIG. 3 illustrates an example of system described in FIG. 1 implemented in a device affixed to a first responder vehicle.

FIG. 3 illustrates an example of system 100 implemented in device 300. Device 300 includes a rocker switch 310, indicator 320, such as one or more LEDs located within the rocker switch or next to it, a transmitter connection port 330, and a vehicle connection port 340. In the illustrated example, the LEDs may flash red when the transmitter is disabled and provide a blue output when active. The device 300 may include fastening mechanisms, such as screws to affix to the device 300 to the first responder vehicle in a location compliant with the safety regulations associated with the vehicle. Of course, any method of fastening, securing or placing it safely in the vehicle may be used.

As shown in FIG. 3, the rocker switch 310 is provided on the outer casing of the device 300. The rocker switch 310 may be used to supply the input received by input unit 110.

The LED 320 may display an LED based on the operational state indicated by the indicator unit 140. For example, after a detection of an operator brake application is made, the indictor 320 may display a red LED (or a red flashing LED) to indicate that the system 100 is awaiting vehicle input status change, and the transmitter is inactive. Additionally, the indicator 320 may display a blue LED to indicate the power state of transmitting unit 150.

The transmitter connection port 330 may connect to a transmitting unit 150, and provide the signal to deactivate the power applied to the transmitting unit 150. Alternatively, the proving circuit 120 may use the transmitter connection port 330 to determine the power state of the transmitter unit 150.

The vehicle connection port 340 may communicate and receive an indication or signal that the brake system of a vehicle has been activated. Thus, the vehicle connection port 340 may communicate this signal to the brake integration unit 130.

According to the aspects disclosed herein, a seamless control of a transmitting unit 150 is provided. By implementing the systems and methods disclosed herein, wear on devices such as exhaust ventilation systems at a fixed location vehicles is prevented. Further, unnecessary energy losses are prevented. Finally, because human intervention is obviated, errors associated with the operation the devices at a fixed location for housing vehicles are prevented.

In this way, the health of first responders is maximized, while the integrity of the devices and machinery employed to ensure this health is maintained.

Embodiments disclosed herein can be implemented in digital electronic circuitry, or in computer software, firmware, or hardware, including the herein disclosed structures and their equivalents. Some embodiments can be implemented as one or more computer programs, i.e., one or more modules of computer program instructions, encoded on a tangible computer storage medium for execution by one or more processors. A computer storage medium can be, or can be included in, a computer-readable storage device, a computer-readable storage substrate, or a random or serial access memory of volatile or non-volatile type. The computer storage medium can also be, or can be included in, one or more separate tangible components or media such as multiple CDs, disks, or other storage devices.

The Vehicle Transmitter Controller, illustrated in FIG. 3 allows DC power to a truck transmitter module to be interrupted manually by the vehicle operator. Power to the transmitter module is then automatically restored when the vehicle brakes are applied.

The Vehicle Transmitter Controller was designed to allow a vehicle fitted with a truck transmitter to be operated within the radio-frequency reception range of the exhaust ventilation system receiver, but without causing the system to remain energized continuously. Such circumstances might include on-premise outdoor apparatus training exercises, apparatus pump testing, and short-term parking of idling apparatus outside a fire station, as might occur during staging or response conditions. To activate the disable feature, the vehicle operator parks the vehicle in the desired location, sets the parking brake, and observes appropriate wheel chocking and other safety procedures for securing a running vehicle. Then the operator depresses the Controller's rocker switch, activating the controller circuitry and disconnecting DC power from the transmitter module. The rocker switch contains a large red indicator LED which blinks approximately once per second to indicate the transmitter module has been disconnected. The Controller will maintain this condition indefinitely until the vehicle brakes are applied, or the vehicle is turned off. The Controller is designed with a fail-safe philosophy, and by default powers up with the transmitter module DC supply active. The rocker switch contains a blue LED connected to a proving circuit that demonstrates that DC power is present at the transmitter connector. The proving circuit is independent of the control circuitry, allowing immediate visual confirmation of transmitter functionality.

The controller can be affixed directly to the vehicle interior with customer-supplied screws.

The controller controls the truck transmitter module and allows a vehicle operator to disable the transmitter module manually and further automatically re-enables transmitter when vehicle brakes are applied. The transmitter plugs directly into the controller with no modification. The controller may include 12 volt DC, negative ground; optional with a 24V DC negative ground version available. It requires only three connections to a vehicle electrical system (Switched battery B, Ground, and Brake signal). It can be installed on virtually any fire apparatus as well as light trucks and automobiles. The Power Supply for the controller may be the vehicle battery input 12V DC nominal, with a supported range 11.0V through 16.0V (12V units only). The Controller is furnished with approximately 25 feet of three-conductor cable for connection to vehicle electrical system. In the example, the red wire connects to switched battery (Ignition On or automobile Run circuit), the black wire connects to ground and the white wire connects to the vehicle brake signal, which can be derived from the vehicle's power distribution system, from the air brake switch, or from the vehicle brake light circuit. Of course, the colors of the wires may freely vary. A fuse may be used on the battery supply to protect the controller, such as a maximum 2 ampere fuse.

An exhaust ventilation control system wherein a vehicle contains a transmitter device that communicates wirelessly with a receiving device located in a fixed facility does not provide a definitive means of determining the vehicle location beyond vague limits of wireless signal reception strength. An improved method of vehicle location is achieved by integrating additional inputs to the control system with wired or wireless sensors within the facility itself or on the grounds of the premise containing the facility, such as an inductive driveway loop sensor or other sensor to determine when a first responder vehicle has departed the facility premises. A further method of identifying which first responder vehicles are authorized to interact with or activate the control system of a specific fixed facility implements a unique electronic identification tag or label transmitted to the fixed facility's receiving device. The electronic identification tag may contain information about the vehicle such as a vehicle registration number or assigned unit number. Since vehicles are frequently moved between different fixed facilities during normal operations, and may be housed in several different facilities within an organizational unit such as a municipality or military division, a means of human operator control over the electronic identification transmitted is required. A human input actuator such as a rotary or thumb wheel switch can be used to program, append, or change the data contents of the electronic identification tag or label transmitted to the fixed facility's receiving device.

As stated above, issues occur with transmitters in a vehicle being within range of a facility and causing undesirable nuisance operation. The present invention is situationally aware of the vehicles operating within its premises. The system of the present invention may create several activation zones, and use process logic to decide if a system activation of the exhaust ventilation system is required. For example, a facility may be configured to have three zones (although the number of zones may vary by application) with Zone 1—vehicle is inside the building structure; Zone 2—vehicle is outside the building structure but still on the premises; and Zone 3—vehicle is outside the building structure and outside the premises. Zone 1 and Zone 2 detections could make use of optical or range-limited radio frequency ("RF") transmission to notify the control panel of vehicle presence with the building, such as in Zone 1, or outside the building, such as in Zone 2. Optical solutions could be a bar code or an infrared data link.

Range-limited RF solutions could utilize an inductive loop embedded in the floor or wall of the building adjacent to the target vehicle's parking location. Other RF solutions could make use of a passive RF identification tag, which is interrogated by a directional antenna mounted on the exterior of the facility, such as the door of the building at the time the vehicle passes into or out of the door.

Zone 3 detections could make use of the existing RF transmitter/receiver scheme, or use of a passive RF identification tag. An interrogation antenna could be located at the ingress/egress driveways to the premises. Due to the narrow range of activity, the RFID solution would reduce nuisance activations due to vehicle drive-by.

The vehicle proximity data may also be made available for external uses, including integration with automatic personnel dispatch systems, and a facility message display board, which could indicate the locations and engine run status of each vehicle on a particular premise.

As stated above, current exhaust system designs typically use a simple RF transmitter mounted in the vehicle communicating with a stationary receiver mounted in the building as the mechanism for signaling the control panel to activate the exhaust system blower motor. While relatively low-cost and simple, the RF transmitters and receivers have a large and variable activation range. Activating vehicles can be tens to hundreds of feet from the building, and will still activate the system. This frequently results in nuisance activations of the exhaust system. Some vendors have attempted to reduce the nuisance activation issue by using a transmitter encoding scheme to associate specific transmitters with specific receivers. The encoding scheme and the actual encoded signal sent from the transmitter to the receiver is not accessible to the control panel, and the control panel is unaware which vehicle has sent a transmission. For example, a fire department with two fire station buildings, each with an exhaust ventilation system, might elect to program the vehicle transmitters for the vehicles normally housed at each building with different codes. The programming is achieved with switches hidden inside the transmitter device or with a manual transmitter/receiver training exercise. Thus, a vehicle from station 1 traveling past station 2 within range of the RF receiver would not activate station 2's exhaust system. Unfortunately, this creates a new nuisance, whereby transmitter modules must be manually swapped between vehicles if a vehicle normally housed at station 1 is re-located to station 2. For environments with large numbers of buildings and vehicles, such manual swapping would be unacceptably tedious and time-consuming. The primary weakness of existing simple vehicle RF transmitter/receiver solutions is that they have a coverage range of thousands of square feet. It is not uncommon for a vehicle containing a transmitter to activate a building exhaust system receiver from over 500 feet away.

A way to reduce the time spent manually swapping pre-programmed transmitters amongst vehicles would be to furnish a thumbwheel switch or other switch or input 350 accessible by the vehicle operator. The transmitters unique encoding identity could then be changed as desired by the vehicle operator simply by manipulating the switch. Other methods of changing the transmitter encoding identity could be implemented with a pair of momentary contact switches combined with a numeric readout, such as a digital LED readout, a backlit-LCD display, or a vacuum-fluorescent display. The thumbwheel approach is passive and permits viewing of the programmed value without electrically powering the transmitter.

A more sophisticated solution combines operator-programmable vehicle-initiated RF transmitters with a building exhaust system control panel that is proximity-aware of the vehicles operating on the premises and within the building containing the exhaust system it controls. Making an exhaust system control system aware of the operating status and physical location of each vehicle on the premises or within the building represents a complex task. Multiple sensor types and communication mechanisms are required to implement a reliable solution.

In order to assist the control panel with the exhaust system blower activation decision, the control panel should be aware which vehicles are requesting activation via RF transmission. Multiple vehicles may transmit activation requests a synchronously and repetitively. The RF receiver functionality within the control panel provides the vehicle identity information recovered from the received RF signals and uses the data to build a table of requesting vehicles. This table is used in the process logic implemented by the control panel to make exhaust system blower activation decisions. The typical building and premises associated with building exhaust systems can be classified into several distinct proximity zones. Based on the location of vehicles within the proximity zones, the control panel uses process logic, either through digital logic circuitry or by way of an algorithm implemented in software and executed by a supervisory microprocessor circuit within the control panel to decide if a system activation is required. The proximity zones are classified as follows: Proximity Zone 1—Vehicle is inside the building structure; Proximity Zone 2—Vehicle is outside the building structure but still on the premises; and Proximity Zone 3—Vehicle is outside the building structure and off the premises. Detection of premise vehicles and classification of the vehicle within the various proximity zones produces raw data which is used by the control panel, along with vehicle-initiated RF transmitter signals, to determine if the building exhaust system blower should be activated, and depending upon the number of active vehicles, along with other pre-configured parameters, determines the speed of the blower motor. Proximity Zone 1 represents the indoor extents of a building. Because there are likely to be many vehicles parked or stored in a small physical area, simple RF remote-control transmitters with large coverage areas are impractical means for determining the specific location of a vehicle. A much-more limited range communications technique must be used that can be readily incorporated into existing building structures without excessive cost or introducing electromagnetic interference to existing radio communications equipment. In the majority of first-responder applications, vehicles located in a building structure are parked in specific fixed locations, dictated by facility policy, space restrictions, and guidance markings on the facility walls or floor. Specific vehicles have dedicated parking locations which do not change. Repeated polling of the parking location for information about the presence or absence of a vehicle is required to determine which vehicles are in a building structure at a given time. Several technologies can be used to achieve this polling implementation.

A passive RFID tag and a closely located interrogation antenna mounted near each of the parking locations within the building provides a tightly-targeted method of determining which vehicles are located at a specific parking location. The identity data provided by the RFID tag is arbitrary and determined when the RFID tag is manufactured, however, it is assigned to the vehicle during programming of the control panel. An active RFID tag could be used to allow field programming of the RFID tag data.

An alternative limited-range vehicle identity-detection scheme uses a direct line-of-sight infrared optical data link between the vehicle and a passive optical receiver mounted near each of the parking locations within the building.

A second alternative limited-range vehicle identity-detection scheme uses a passive reflective bar code on the vehicle surface, and an LED, laser, or camera-based machine vision device to optically confirm the identity of a given vehicle in the parking place. Information about which vehicles are located inside a building structure represents only a portion of the information needed to for the control panel to make exhaust system blower activation decisions. Once a vehicle departs from its normal parking place, polling of the parking location will indicate the vehicle is not present. However, the vehicle may have been moved to another location within the building, or may no longer be transmitting information due to a failure or maintenance activity. Proximity Zone 2 represents the area immediately outside a building structure, such as a fire station parking lot and ingress/egress driveways. Vehicles, such as fire apparatus, are often staged outside the building structure for testing and maintenance or training exercises. Exhaust system activation is not required for these vehicles because they are outside the building, but they are still on the premises and within vehicle-mounted RF transmitter range.

Sensors located at the vehicle ingress/egress doors of the building structure are used to determine that a vehicle is entering or leaving the building. Using the same RFID or optical technologies described above, information about vehicle movement is provided to the control panel logic as an additional data stream for the system activation decision algorithm.

Using the same concepts set forth above, an additional set of sensors located at the vehicle ingress/egress driveways of the premises are used to determine that a vehicle is entering or leaving the outdoor area surrounding the building. This information is also provided to the control panel logic as an additional data stream for the system activation decision algorithm. With all of the vehicle proximity information provided to the control panel logic, a supervisory circuit, including a microprocessor executing a software algorithm, maintains a table of vehicle identities, and the current real-time status of the vehicles. This table is used to make the final exhaust system blower activation decision.

This vehicle information is also of interest to human command, control, and supervisory staff, and is made available to external devices. The vehicle proximity data table can be accessed as simple ASCII plain-text data via a serial communications link. Real-time updates of system status, alarms, and other data are also accessible through the serial communications link.

The vehicle status information is displayed on a digital display device, indicating the building or premise normally assigned vehicles, their status, including vehicle engine running, vehicle engine off, in service, out-of-service, mission-capable, not mission a-capable, outside the building, outside the premise, test mode, and other information. In addition, the digital display device provides the ability to override exhaust system activation by a particular vehicle, and the ability to alter the configuration of the control panel operations.

Reliability is a significant concern for a building exhaust system and its associated control panel. Vehicle proximity detection is subject to sensor failure, field programming errors, and unexpected vehicle placement during certain emergency conditions. The advanced vehicle proximity methods above are implemented within the control panel supervisory circuit as a separate logic layer, and in the event of sensor failures or manually requested disablement, the separate logic layer is ignored and the control panel will activate the exhaust system blower based on the most simple stimulus input which is the reception of a signal from a vehicle RF transmitter with the appropriate code. Manual activation of the system by a control panel switch must always override any other activation stimulus inputs.

In addition, the present invention also may incorporate a quality control check to minimize human error effects as well as reduce incidents of accidently turning off the system or even flag malfunctions with the system. Current control solutions for exhaust ventilation systems provide no means to monitor the performance of the system and provide audible, visual, and remote alarms for reduced performance or failures of the system. Failures may include electrical supply issues, motor failure, blower clogging or failure, clogged inlet hoses, and building air pressure and air quality problems. Human error may include improper placement of hoses, pinched hoses, accidental or intentional shutoff of the system or vehicle transmitter as well as a host of other items. As particulate matter is strongly associated with occupational and workplace-related lung disease, the primary pollutant removed by most exhaust ventilation systems is particulate matter. A malfunctioning system therefore represents an immediate health risk to the occupants of the building, particularly if the failure is repeatable. The present invention may include a control system that is in communication with the various sensors to detect blower failure, such as by way of a diaphragm switch, fan speed sensors or other system related sensors. The control system may also be in communication with one or more air quality monitoring sensors which may take periodic or continuous air quality measurements. For example, a laser particle counter may be included and notify the control system when particle counts exceed programmed thresholds. The program thresholds could cause the system to start, increase the volume of air being evacuated or even alert building occupants to a non-performing system. Common causes of elevated particle counts could include flexible exhaust hoses not properly connected to their target vehicle, or generation of dust or smoke via maintenance operations without proper use of a fume arm inlet. The performance alarms could then summon personnel to make appropriate investigations of the system and attempt to resolve the issue. The failures may also be logged so patterns of when failures occur could be determined and corrected. Present control solutions for exhaust ventilation system provide no way of measuring system usage, such as run time hours or activation counts. Such measurements are used by the present invention to alert operators regarding required maintenance of mechanical components like motor bearings and blower impeller blades, scheduling visual inspection of flexible hoses for wear or soot accumulation, and checking the rigid or flexible piping and manifold network. The measurements are built into the control system, and output visually or audible to a user through improved control panels or software that include an activations counter and a running time meter.

The present invention and control system could be used in other applications as well. For example, the proximity sensor may be used to turn off and on other types of equipment useful or used in connection with vehicles. In addition, the control system may integrate additional features, such as a connection status. Example of a connection status would be when the vehicle is parked in a desired location with the proximity sensor determining it is parked in that location, power could be connected to the vehicle, and the power connection verified by the control system as an acceptable connection status. For example, with first responder vehicles, many of them contain numerous electronic devices and items that draw power from the vehicle's battery. When the vehicle is parked without the engine running and there is no way to charge or maintain the charge on the battery, and as such, the battery may draw down to a state where it is incapable of starting the vehicle. The reduction in battery performance is due to the power draw from such electronic devices, and if it occurs repeatedly, the battery may no longer function as intended. As a battery may drain quickly, depending on the level of power draw, leaving the vehicle disconnected from a power source may cause the vehicle to be inoperable when needed for an emergency. As many first responder vehicles sit fixed for long periods of time until needed and contain numerous electrical items, a mission incapable vehicle is a serious problem. To address this problem, most vehicles are capable of being connected to the facility electrical system to maintain a charge. The system of the present invention may determine when the vehicle is in the desired location and static, and provide a warning if the vehicle is not drawing power from the facility electrical system to maintain its mission capable status. The warning may be an enunciator lamp on the control system or other form of warning, or may include advanced warnings that are configurable to escalate after the vehicle has been static for a set time period. For example, once the system shuts off the exhaust ventilation system, such as for that particular vehicle, it may verify vehicle connection to a power source, and provide a warning until verification is received. The system may also work with vehicles in cold climates that must be heated for an easy start, such as many diesel engines in first responder vehicles. While many first responder vehicles are housed in facilities, a number of others, such as commercial vehicles, maintenance vehicles, airport vehicles and the like are parked outside and need to be plugged into the facility electrical system to heat the engine block when not being used. As such, the system could warn an airport, a bus terminal, or delivery service if a vehicle parked overnight in a fixed location is not drawing power either to charge electrical items, or to heat the block to ensure ready operation. Furthermore, the system could control power draw by controlling the cycling off and on of the power provided to the vehicles based on outside temperature or other conditions.

The present invention improves operation of the exhaust ventilation system, particularly the longevity and reliability of the motor by replacing or supplementing the mechanical contactor with an electronic variable frequency drive, also commonly called a motor inverter. A variable frequency drive is a sophisticated pre-packaged motor control device that is capable of starting and stopping a motor connected to it, and can also vary the speed of the motor by varying the frequency of the supply current to the connected motor. The variable frequency drive can also be used to modulate the speed of the motor based on building-initiated and vehicle-initiated stimulus inputs to the control panel. Motor speed modulation would allow modification of the airflow through the blower housing, specifically modification of the amount of air removed from the facility in a given time period. As such, the flow rate of the system can be adjusted to the number of vehicles actively producing exhaust gases and particulate matter. If only one vehicle is operating in a large building in a system sized for many vehicles, the blower or exhaust fan could be operated at a slower or reduced speed, reducing the amount of conditioned air that is vented outside the building while still sufficiently evacuating vehicle exhaust.

Another benefit is that the variable frequency drive can also significantly extend motor and electrical equipment life by starting the motor gradually by reducing the in-rush current associated with motor start. The gradual start is particularly beneficial for single phase motors. Many variable frequency drive devices also contain protective circuits that monitor the input voltage supply and can be programmed to shut down and generate an alarm signal in the event of an electrical supply deficiency. In some circumstances, variable frequency drive devices may be configured to allow the use of three-phase motors in buildings where three-phase electrical supply is unavailable. In such situations, the variable frequency drive is supplied with single-phase electrical supply, and synthesizes a stable three-phase supply for the connected motor.

Another benefit of a variable frequency drive working in cooperation with the control system of the exhaust ventilation system is the simplification of the supply chain for the manufacture and installation of exhaust ventilation systems. More specifically, similar variable frequency drive devices allow use of the same motor types for buildings with either single or three-phase electrical supply and the use of mechanically and electrically simpler electric three phase motors. Reduction in control panel variations would also allow simplified design, documentation, training, and maintenance due the similarity of designs, and minimize customization to a particular facility other than minor changes to a control algorithm. The variable frequency drive is a complex, pre-packaged device and failure inside the device often requires replacement of the entire variable frequency drive device. The present invention allows for an alternate mechanism of temporary operation in the event of variable frequency drive failure. In three-phase power supplies and motors, the system retains the electromechanical contactor in parallel with the variable frequency drive. As there is no such direct equivalent for single-phase applications, in a single-phase application, the present invention allows a redundant variable frequency drive to be supplied in parallel with the primary variable frequency drive device as a backup.

The invention claimed is:

1. A vehicle device for controlling exhaust ventilation systems in facilities, said vehicle device comprising:

a transmitter;

a controller in communication with said transmitter;

an input unit in communication with said controller and capable of receiving an operator input from an operator of a vehicle, and wherein said operator input includes an activation input and a deactivation input and wherein upon receiving said deactivation input, said controller sends a deactivation signal to said transmitter, placing said transmitter into a deactivated state and upon receiving an activation input, said controller sends an activation signal to said transmitter, placing said transmitter into an active state; and a brake input unit and wherein said brake input unit is capable of receiving a brake input from the brake system on the vehicle, and wherein said brake input includes a brake active signal and a brake inactive signal and wherein said controller upon receiving a brake active signal from said brake unit, sends an activation signal to said transmitter placing said transmitter into said active state.

2. The vehicle device of claim 1 wherein said controller is configured to send a deactivation signal to said transmitter upon receiving a brake active signal while receiving a deactivation input from said input unit.

3. The vehicle device of claim 1 further including an indicating unit configured to indicate whether the transmitter is in an active state or a deactivated state.

4. The vehicle device of claim 3 further including a proving circuit configured to determine the state of the transmitter.

5. The vehicle device of claim 1 further including a unique ID capable of being transmitted by the transmitter.

6. The vehicle device of claim 5 wherein said unique ID is associated with a particular facility and wherein a unique ID not associated with a facility will not activate a facility exhaust system not associated with the unique ID.

7. The vehicle device of claim 1 wherein said input device further includes a facility selection input.

8. A method of controlling a vehicle exhaust system in a building with a vehicle device on a vehicle, the facility exhaust system including a receiver and the vehicle device including a controller, a transmitter, an input unit, and the vehicle having a power supply and a brake system, said method comprising the steps of:

determining that the transmitter is providing an activation signal;

monitoring for a deactivation signal from the input unit;

receiving a deactivation signal from the input unit;

outputting a deactivation signal to the transmitter;

monitoring for a vehicle input signal related to initiating movement of the vehicle;

receiving said vehicle input signal;

outputting an activation signal to the transmitter upon receiving said vehicle input signal; and communicating an activation signal to the receiver with the transmitter.

9. The method of claim 8 further including the step of wherein said step of receiving a vehicle input signal includes at least one of (1) receiving the brake active signal from the brake system and (2) a change in gear status.

10. The method of claim 9 wherein said step of receiving a vehicle input signal includes the steps of:

monitoring for a brake active signal from the brake system; and receiving a brake active signal from the brake system.

11. The method of claim 10 wherein said step of receiving a brake active signal from the vehicle brake system includes at least one of (1) receiving a voltage signal when the brake lights are illuminated, (2) receiving input activated by movement of the brake pedal, (3) receiving input related to a change in braking system pressure, (4) receiving an input from a Controller Area Network (CAN) of the vehicle related to the status of the brake system, and (5) releasing of the parking brakes.

12. The method of claim 8 wherein said step of outputting a deactivation signal to the transmitter is configured to deactivate power supplied to the transmitter.

13. The method of claim 8 further including the step of providing an output status.

14. The method of claim 8 further includes the steps of:

leaving the facility with the vehicle and wherein the transmitter is active upon leaving the facility;

parking the vehicle within range of the receiver; and creating a deactivation signal with the input unit.

15. The method of claim 8 wherein said step of receiving the input signal includes the step of moving the brake pedal.

16. The method of claim 8 wherein said step of outputting an activation signal to the transmitter upon receiving said vehicle input signal automatically occurs.

17. The method of claim 16 wherein said step of outputting an activation signal to the transmitter upon receiving said vehicle input signal further includes the step of ignoring any deactivation signal being provided from said input unit upon receiving said vehicle input signal.

18. The method of claim 8 further including the steps of:

moving the vehicle with the transmitter providing an activation signal; and ignoring any deactivation signal received from the input unit from the input unit until a vehicle stop condition is determined.

19. The method of claim 18 wherein said vehicle stop condition is at least one of (1) placing the transmission in park, (2) activating the parking brake, and (3) sustained speed of zero.

20. A method of controlling a vehicle exhaust system in a building with a vehicle device on a vehicle, the facility exhaust system including a receiver and the vehicle device including a controller, a transmitter, an input unit, and the vehicle having a power supply and a brake system, said method comprising the steps of:

determining that the transmitter is providing an activation signal;

monitoring for a deactivation signal from the input unit;

receiving a deactivation signal from the input unit;

determining a desired vehicle status exists, wherein said desired vehicle status includes at least one of: (1) engine speed, (2) brake status, (3) transmission status, (4) change in transmission status, (5) parking brake status, (6) proximity to facility exhaust system, and (7) speed of the vehicle;

outputting a deactivation signal to the transmitter after said step of determining a vehicle status;

monitoring for a vehicle input signal related to initiating movement of the vehicle;

receiving said vehicle input signal of at least one of (1) receiving the brake active signal from the brake system and (2) a change in gear status;

automatically outputting an activation signal to the transmitter upon receiving said vehicle input signal;

communicating an activation signal to the receiver with the transmitter; and providing an output status.

21. The method of claim 20 wherein said step of outputting an activation signal to the transmitter upon receiving said vehicle input signal further includes the step of ignoring any deactivation signal being provided from said input unit upon receiving said vehicle input signal.

22. The method of claim 20 further including the steps of:

moving the vehicle with the transmitter providing an activation signal; and ignoring any deactivation signal received from the input unit from the input unit until a vehicle stop condition is determined.

23. The method of claim 22 wherein said vehicle stop condition is at least one of (1) placing the transmission in park, (2) activating the parking brake, and (3) sustained speed of zero.

* * * * *